211-70.5 SR
7/1/86 OR 4,597,496

United States Patent [19]

Kaplan

[11] Patent Number: 4,597,496

[45] Date of Patent: Jul. 1, 1986

[54] FRICTIONAL GRIP TOOL HOLDER

[75] Inventor: Steve E. Kaplan, Elyria, Ohio

[73] Assignee: Pioneer Products, Inc., Elyria, Ohio

[21] Appl. No.: 441,608

[22] Filed: Nov. 15, 1982

[51] Int. Cl.[4] ..... A47F 5/08

[52] U.S. Cl. ..... 211/70.6; 211/89

[58] Field of Search ..... 211/60 T, 60 R, 89, 211/94, 66, 68; 248/111, 314, 316.9, 317

[56] References Cited

U.S. PATENT DOCUMENTS

| | | | |
|---|---|---|---|
| 1,958,772 | 5/1934 | Stewart | 24/257 |
| 1,992,857 | 2/1935 | Breedlove | 131/21 |
| 2,121,307 | 6/1938 | Swift | 211/89 X |
| 2,471,680 | 5/1949 | Gibson, Jr. | 15/143 |
| 2,785,919 | 3/1957 | Grondzik | 294/5.5 |
| 2,956,687 | 10/1960 | Robichaud | 211/74 |
| 3,063,569 | 11/1962 | Huber | 211/89 |
| 3,725,147 | 11/1955 | Vogler | 211/66 |
| 4,325,484 | 4/1982 | Berry | 211/89 X |

FOREIGN PATENT DOCUMENTS

| | | | |
|---|---|---|---|
| 675340 | 1/1966 | Belgium | 211/89 |
| 491967 | 4/1953 | Canada . | |
| 3024414 | 1/1982 | Fed. Rep. of Germany | 211/66 |

*Primary Examiner*—Robert W. Gibson, Jr.
*Attorney, Agent, or Firm*—Alfred D. Lobo

[57] ABSTRACT

The frictional grip tool holder includes an extruded plastic housing (A). The extruded housing defines an integral, first mounting channel (12) and a facing second mounting channel (14) which define a planar region therebetween. The housing further defines an integral stabilizing channel (20) which is disposed directly above the midpoint of the planar region. A first resilient finger array (B) is mounted in the first mounting channel extending along the planar region; and a second finger array (C) is mounted in the second mounting channel extending along the planar region. The first and second finger arrays terminate in free finger ends (40, 42) contiguous with each other below the stabilizing channel. A bolt-like threaded member (50) extends through the housing adjacent the first and second mounting channels. A threaded knob (52) is received on a threaded end of the bolt-like member for selectively urging the first and second mounting channels toward each other against the resilient biasing of the plastic material of the housing and for selectively permitting the resilient plastic material of the housing to urge the first and second channels further apart.

13 Claims, 8 Drawing Figures

FRICTIONAL GRIP TOOL HOLDER

BACKGROUND OF THE INVENTION

The present invention pertains to apparatus for frictionally gripping, particularly hanging, tools and other objects.

Heretofore, various types of holders have been developed for hanging tools and other objects. One such prior art holder is illustrated in U.S. Pat. No. 3,063,569, issued Nov. 13, 1962 to J. R. Huber. An aluminum housing which was mounted horizontally on a wall defined a pair of oppositely disposed horizontal channels. The channels supported first and second arrays of resilient fingers in a substantially horizontal plane therebetween. Tools and the like were urged vertically through the resilient fingers which would flex to receive the tool and frictionally engage it to hold it in place. To remove the tool, it was pulled against the frictional engagement of the resilient fingers.

Commonly, the various tools and other objects which one may wish to hang have varying weights and diameters. One of the problems with the prior art holders is that they were adapted to hang objects in a relatively narrow range of weights and diameters.

Another problem with the prior art tool holders is that they permitted hanging objects to be shifted from the preferred vertical orientation. Moving an object from the vertical orientation altered the frictional engagement with the resilient fingers, frequently allowing the tool to fall or be released unexpectedly.

The present invention contemplates a new and improved holder for tools and other objects which overcomes these problems and others.

SUMMARY OF THE INVENTION

In accordance with a first aspect of the invention, there is provided a holder for frictionally retaining tools and like objects. The holder includes a first array of flexible fingers disposed with one end free and another end operatively connected with a first mounting means. A second array of flexible fingers is disposed with one end free and another end operatively connected with a second mounting means. The first and second finger free ends are disposed contiguous such that the first and second finger arrays are adapted to be flexed at least in part into frictional engagement with a tool urged therebetween. Adjusting means selectively adjusts the relative position of the first and second finger arrays such that the degree of frictional engagement with the received tool is selectively adjusted. In this manner, the holder is adjustable to receive tools of different sizes as well as tools of different weights.

In accordance with another aspect of the invention, there is provided a holder for frictionally retaining objects such as tools. A housing includes oppositely disposed first and second mounting channels which define a generally planar region therebetween and a stabilizing channel displaced from a facing toward the mounting channel planar region. A first array of resilient fingers which have free ends generally opposite the stabilizing channel are mounted adjacent their other ends in the first mounting channel. A second array of resilient fingers which have free ends contiguous with the first finger array free ends are mounted adjacent their other ends in the second mounting channel. In this manner, a tool or other object received between the first and second finger arrays is adapted to be received in the stabilizing channel to stabilize and fix its orientation.

A first advantage of the present invention is that it is selectively adjustable for hanging objects such as tools having varying sizes and diameters as well as objects having varying weights.

Another advantage of the present invention is that it maintains the objects hanging in a vertical orientation.

Yet another advantage of the present invention is that it biases the resilient fingers upward and restrains sagging of the fingers.

Still further advantages of the present invention will become apparent upon reading and understanding the following detailed description of the preferred embodiment.

BRIEF DESCRIPTION OF THE DRAWINGS

The invention may take form in various parts and arrangements of parts. The drawings, which illustrate preferred embodiments of tool holders in accordance with the present inventions are not to be construed as limiting the invention.

DETAILED DESCRIPTION OF THE PREFERRED EMBODIMENTS

Figure 1:
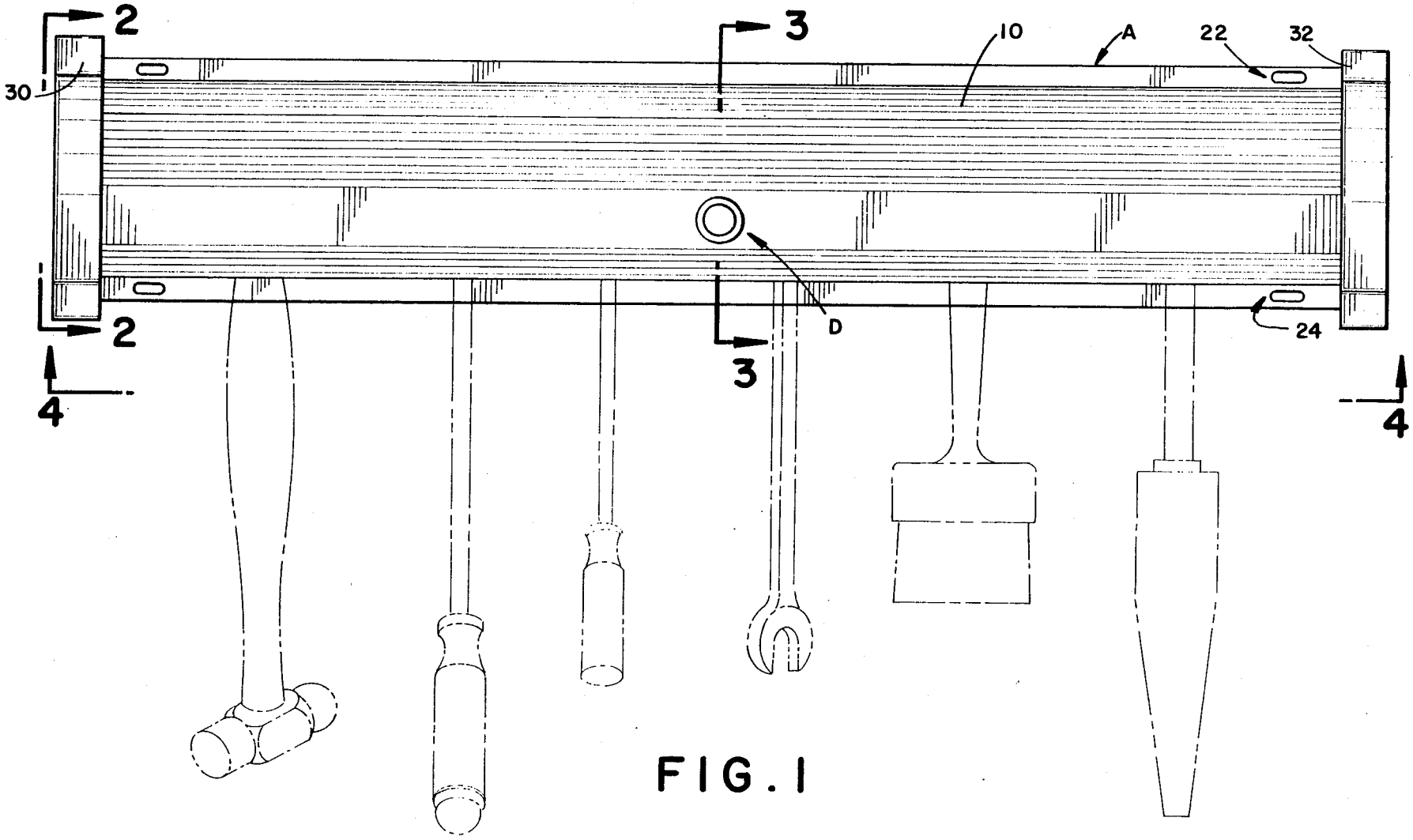
FIG. 1 is a front elevational view of a tool holder in accordance with the present invention with tools hanging therefrom illustrated in phantom.
Figure 4:
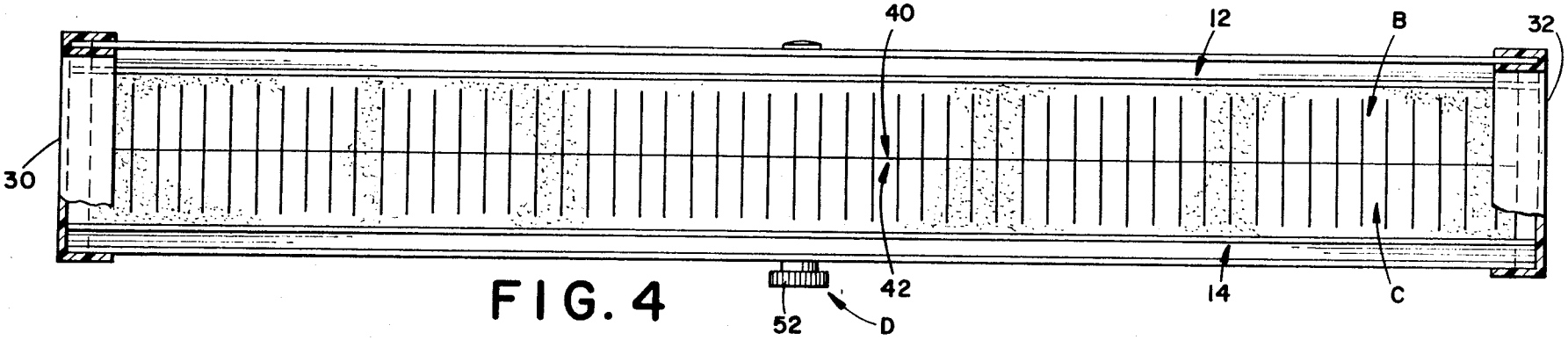
FIG. 4 is a bottom view in partial section of the tool holder of FIG. 1.
Figure 3:
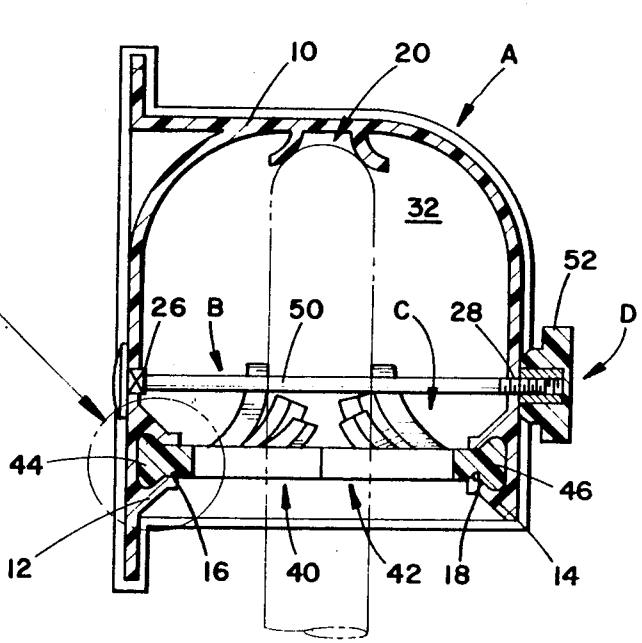
FIG. 3 is a sectional view through section 3—3 of FIG. 1 with a received tool illustrated in phantom.

With particular reference to FIGS. 1 and 3, the holder includes a plastic housing A which supports a first array of resilient fingers B and a second array of resilient fingers C. An adjustment means D selectively controls the relative position of the first and second finger arrays.

Figure 5:
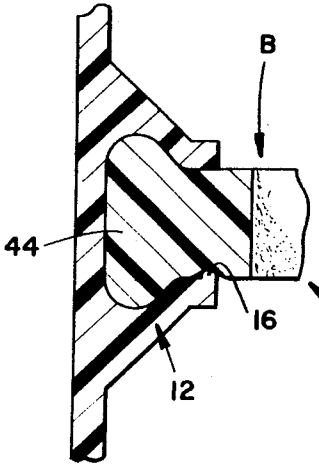
FIG. 5 is an enlarged view of a resilient finger mounting channel portion of FIG. 3.
Figure 2:
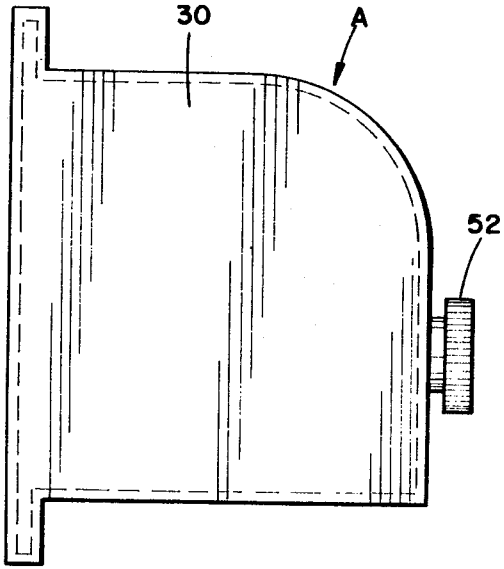
FIG. 2 is an end view of the holder of FIG. 1.

The housing A includes a one piece, extruded central portion 10. In the preferred embodiment, the central portion is formed from a continuous extrusion of polyvinylchloride (PVC) which cools quickly yet provides high strength and good resiliency. The housing integrally defines a first mounting means or channel 12 for mounting one end of the first finger array and a second mounting means or channel 14 for mounting the second finger array. The first and second mounting channels defines a generally planar region therebetween. The first and second mounting channels are generally U-shaped with enlarged inner ends and have open sides facing toward each other. The first mounting channel has a first projection or means 16 (FIG. 5) adjacent the first channel open side for biasing the first finger array upward and restraining it against downward movement. Similarly, a second projection or means 18 adjacent the second mounting channel open end biases the second finger array upward and restrains its downward movement.

With particular reference to FIG. 3, the housing integrally defines a stabilizing means or channel 20 which is adapted to receive the end of the hung object or tool therein. The stabilizing channel 20 faces perpendicular to the plane defined between the first and second mounting channels and is disposed substantially midway between the first and second mounting channels. In this manner, the stabilizing channel 20 fixes the held object in a vertical position in which it is frictionally engaged substantially equally by both the first and second finger arrays.

With particular reference to FIG. 1, the housing further includes upper mounting means 22 and lower mounting means 24 for facilitating mounting the housing on a vertical wall surface or the like. With further reference to FIG. 3, a rectangular adjusting means receiving aperture 26 is disposed in the housing back wall and a circular adjusting means receiving aperture 28 is disposed in the housing front wall. The housing further includes one piece plastic end caps 30 and 32 on either end of the extruded portion 10.

With particular reference to FIG. 3, the finger arrays B and C extend along the horizontal plane defined between the first and second mounting channels. The finger arrays terminate in free ends 40 and 42, respectively, disposed contiguously midway between the first and second mounting channels 12 and 14 and centered below the stabilizing channel 20. The fingers of the first and second arrays are interconnected at their opposite or mounted ends 44 and 46, respectively, which ends are securely received in the first and second mounting channels, respectively. The fingers are constructed of resilient material which is sufficiently resilient that it firmly engages the received object and which has a non-slip surface for restraining the object from sliding out of engagement. In the preferred embodiment, neoprene or other synthetic rubbers are preferred. However, other polymeric materials and natural rubber are also contemplated.

With continued reference to FIG. 3, the adjusting means D includes a first threaded member 50 which is received in a threaded engagement with a second threaded member 52. More specifically, the first threaded member is a bolt-like member which is non-rotatably received in the square housing aperture 26 at one end and includes an elongated portion which extends through the second housing opening 28. The second threaded member 52 is a knob having a threaded bore therein which threadedly receives the threaded end of the first threaded member. By selectively rotating the knob relative to the first threaded member, the first and second mounting channels are selectively urged toward each other against the resilient biasing of the plastic housing or allowed to move apart under the resilient urging of the plastic housing. In this manner, the adjusting means selectively adjusts the spatial relationship of the channels. Optionally, the adjusting means may also adjust the angle of the first and second finger arrays.

Figure 6:
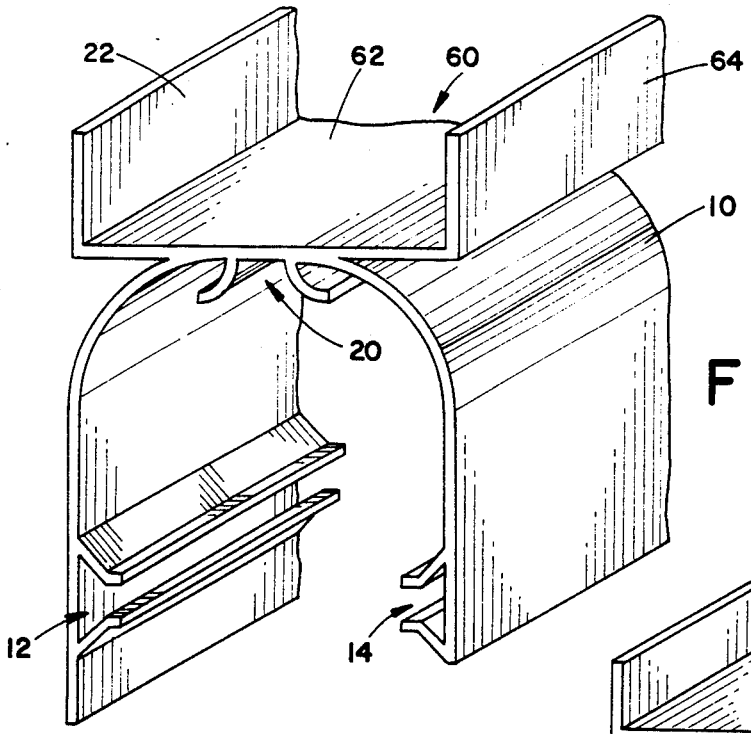
FIG. 6 illustrates an alternate embodiment of a tool holder in accordance with the present invention.

In the embodiment of FIG. 6, the housing 10 is extruded with an integral tray 60 along its top side. The tray includes the rear mounting flange 22, a flat lower surface 62, and a forward flange 64.

Figure 7:
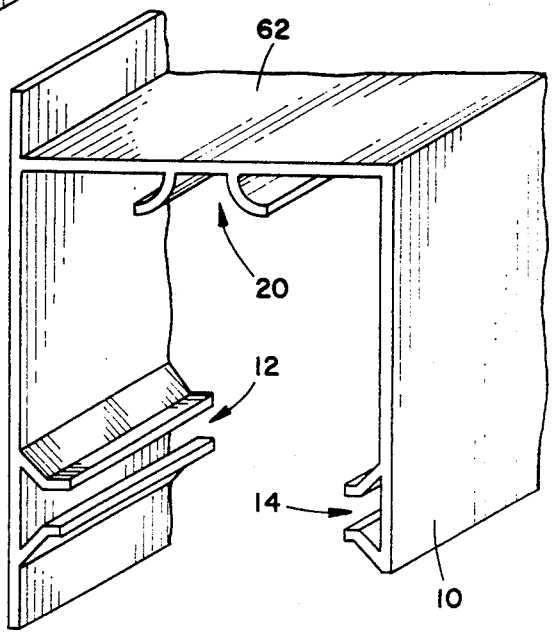
FIG. 7 illustrates another alternate embodiment of the present invention; and, FIG. 8 illustrates yet another alternate embodiment of the present invention.

In the embodiment of FIG. 7, the housing 10 is extruded with a rectangular or square cross section. This provides a flat top shelf 62 for receiving small objects for storage.

Figure 8:
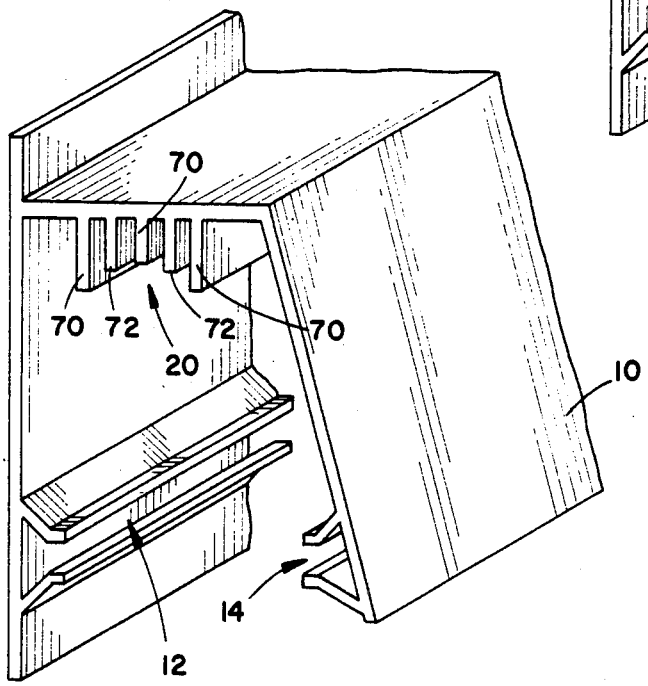

In the embodiment of FIG. 8, the housing 10 is generally trapezoidal in cross section. The stabilizing channel 20 is defined by a plurality of vertical ribs of varying length. Specifically, outer ribs 70 are relatively long, intermediate ribs 72 are shorter, and a central rib 74 is the shortest.

The invention has been described with reference to the preferred embodiments. Obviously, alterations and modifications will occur to others upon reading and understanding the preceding detailed description of the preferred embodiments. It is intended that the invention be construed as including all such alterations and modifications insofar as they come within the scope of the appended claims or the equivalents thereof.

Having thus described a preferred embodiment of the invention, the invention is now claimed to be;

1. A holder for frictionally retaining objects such as tools, the holder comprising:

a housing including oppositely disposed first and second mounting channels which define a generally horizontal, planar region therebetween, the first and second mounting channels being generally U-shaped with first and second open sides facing toward each other, the first mounting channel having a first projection adjacent the first channel open side extending upward for urging a received finger array against gravitational force and the second mounting channel having a second projection adjacent the second channel open side extending upward for urging a received finger array against gravitational force;

a first array of resilient fingers which have free ends and which are mounted adjacent mounting ends in the first mounting channel;

a second array of resilient fingers which have free ends contiguous to the first finger array free ends and which are mounted adjacent mounting ends in the second mounting channel; and, an adjusting means for selectively controlling the spacing between the free ends of the first and second resilient finger arrays.

2. The holder as set forth in claim 1 wherein the housing is extruded polyvinylchloride, whereby the first and second mounting channels are adapted to be resiliently flexed from their extruded relationship with each other.

3. A holder for frictionally retaining objects such as tools, the holder comprising:

a housing including oppositely disposed first and second mounting channels which define a generally planar region therebetween, a generally flat upper surface, and a pair of upstanding flanges along opposite edges of the upper surface to define a storage tray along the top of the housing;

a first array of resilient fingers which have free ends and which are mounted adjacent mounting ends in the first mounting channel; and, a second array of resilient fingers which have free ends contiguous to the first finger array free ends and which are mounted adjacent mounting ends in the second mounting channel.

4. A holder for frictionally retaining objects such as tools, the holder comprising:

a housing including oppositely disposed first and second mounting channels which define a generally planar region therebetween, and a stabilizing channel displaced from and facing toward the mounting channel planar region;

a first array of resilient fingers which have free ends and which are mounted adjacent mounting ends in the first mounting channels;

a second array of resilient fingers which have free ends contiguous to the first finger array free ends and which are mounted adjacent mounting ends in the second mounting channel; and, adjusting means for selectively adjusting the spatial relationship between the first and second finger array free ends, whereby the degree of frictional engagement between the finger arrays and an object retained therebetween is selectively adjusted.

5. The holder as set forth in claim 4 further including housing mounting means for mounting the housing to an associated structure with the mounting channel planar region disposed horizontally and the stabilizing channel disposed substantially in vertical alignment with the first and second finger array free ends.

6. The holder as set forth in claim 4 wherein the adjusting means adjusts the contiguity of the first and second finger array free ends.

7. A holder for frictionally retaining objects such as tools, the holder comprising:

a housing including oppositely disposed first and second mounting channels which define a generally planar region therebetween;

a first array of resilient fingers which have free ends and which are mounted adjacent mounting ends in the first mounting channel;

a second array of resilient fingers which have free ends contiguous to the first finger array free ends and which are mounted adjacent mounting ends in the second mounting channel; and, an adjusting means for selectively adjusting the contiguity of the first and second finger array free ends, the adjusting means including an elongated element which is operatively connected adjacent the first mounting channel and a cooperating element which engages the housing adjacent the second mounting channel, the elongated and cooperating elements being threadedly interconnected such that relative rotation therebetween adjusts the contiguity of the mounting channels.

8. The holder as set forth in claim 7 wherein the elongated element is non-rotatably connected adjacent the first mounting channel and has a threaded portion extending through the housing adjacent the second mounting channel and wherein the cooperating element includes a knob with a threaded bore which is threadedly received on the elongated element threaded portion and which frictionally engages the housing.

9. A holder for frictionally hanging objects such as tools, the holder comprising:

an extruded plastic housing portion which includes integral first and second mounting channels and an integral stabilizing channel, the first and second mounting channels being generally U-shaped with open faces disposed toward each other and defining a generally planar region therebetween, the stabilizing channel being displaced from and facing generally perpendicularly toward the planar region, generally midway between the first and second mounting channels, the first and second mounting channels each including projections extending generally toward the stabilizing channel, the housing including mounting means for mounting the housing to a generally vertical structure in such a manner that the planar region is substantially horizontal;

a first array of resilient fingers mounted in the first mounting channel, extending generally along the planar region, and terminating in free ends generally midway along the planar region;

a second array of resilient fingers mounted on one end in the second mounting channel and extending along the planar region, the second planar array of fingers terminating in free ends contiguous with the first finger array free ends; and, a bolt-like adjusting member connected at a head end with the housing portion adjacent the first mounting channel, and extending across the housing and through the housing adjacent the second mounting channel, the bolt-like adjusting member being threaded adjacent the second mounting channel and being threadedly received in a threaded bore of a knob member such that rotating the knob member relative to the elongated member selectively urges the first and second mounting channels toward each other against the resilient biasing of the plastic housing portion and selectively allows the resilient biasing of the plastic housing portion to move the first and second channel portions apart.

10. A holder for frictionally retaining objects such as tools, the holder comprising:

a one piece plastic extrusion which integrally defines first and second spaced finger array mounting means for mounting arrays of flexible fingers generally horizontally;

a first array of flexible fingers disposed with one end free and another end operatively connected with the first finger array mounting means;

a second array of flexible fingers disposed with one end free and another end operatively connected with the second finger array mounting means, the first and second finger free ends being disposed contiguously such that the first and second arrays of fingers are adapted to be flexed at least in part into frictional engagement with a tool urged therebetween;

the first and second mounting means being biased toward a preselected spatial relationship by a resiliency of the plastic extrusion;

an adjusting means for selectively urging the first and second mounting means into a more proximate spatial relationship against the resilient biasing of the plastic extrusion; and, the one piece plastic extrusion defining a horizontally extending stabilizing channel disposed centrally of the first and second finger array free ends and vertically thereabove and which channel in narrower than a spacing between the first and second finger array mounting means for maintaining the retained objects substantially vertical.

11. The holder as set forth in claim 10 wherein the first and second mounting means mount the first and second finger arrays substantially horizontally.

12. The holder as set forth in claim 11 wherein the first and second mounting means include means for restraining downward movement of the first and second finger arrays.

13. The holder as set forth in claim 10 wherein the adjusting means includes first and second threadedly connected members and means for facilitating rotation of one of the threaded members relative to the other for selectively adjusting their threaded engagement, the first threaded member being operatively connected with first mounting means and the second threaded member being operatively connected with the second mounting means.

* * * * *